United States Patent [19]

Salas

[11] Patent Number: 4,921,545

[45] Date of Patent: May 1, 1990

[54] HARVESTER FOR REMOVING A SUBSTANCE FROM A PLATE

[75] Inventor: Gerardo A. Salas, Las Vegas, Nev.

[73] Assignee: Kerr-McGee Chemical Corporation, Oklahoma City, Okla.

[21] Appl. No.: 301,405

[22] Filed: Jan. 25, 1989

[51] Int. Cl.[5] ..... B08B 7/02

[52] U.S. Cl. ..... 134/16; 204/96; 204/35.1; 55/12; 55/112

[58] Field of Search ..... 55/13, 12, 112; 204/96, 204/105 R, 222, 105 M, 35.1; 15/89; 134/16

[56] References Cited

U.S. PATENT DOCUMENTS

| | | | |
|---|---|---|---|
| 1,767,265 | 6/1930 | Sykes | 55/112 |
| 2,372,997 | 4/1945 | Yerrick et al. | 134/16 |
| 3,094,437 | 6/1963 | Scheer | 134/16 |
| 3,294,665 | 12/1966 | Roller | 204/96 |

OTHER PUBLICATIONS

Brochure Pages. Sheet No. 2 "Tamper".
Brochure Pages. Sheet No. 3 "Standard Moll Point".
Brochure Pages. Sheet No. 4 "Ingersol Rand, Balancers".

*Primary Examiner*—Bernard Nozick
*Attorney, Agent, or Firm*—Herbert M. Hanegan; John P. Ward

[57] ABSTRACT

A harvester for removing a substance deposited on the surface of a plate comprising a tool having a strike end and means for supporting the tool near the surface of the plate so the strike end of the tool strikingly engages the substance on the plate for removing the substance.

12 Claims, 2 Drawing Sheets

HARVESTER FOR REMOVING A SUBSTANCE FROM A PLATE

FIELD OF THE INVENTION

The present invention generally relates to a harvester having a portion for strikingly engaging a substance on a plate for removing the substance from the plate.

DESCRIPTION OF THE PREFERRED EMBODIMENTS

In an electrolytic process for producing manganese dioxide, manganese dioxide was deposited on anodes in an electrolytic cell. The deposited manganese dioxide was a hard, dense grayish-black deposit.

The plates or anodes were removed from the cell and suspended from a track. Individuals then stood in front of the suspended anodes and repeatedly struck the deposited manganese dioxide with large hammers causing the deposited manganese dioxide to break and fall from the anode.

This manual method of harvesting the manganese dioxide resulted in fragments of broken manganese dioxide flying from the anode and, in some instances, striking the individual resulting in injury. Also, this manual method, resulted in fatigue and strain on the part of the individuals.

The present invention provides a means for harvesting manganese dioxide from anodes in a safer, more efficient and more economical manner, and in a manner which results in less fatigue and strain on the part of the individual operators.

The present invention is not limited to removing deposited manganese dioxide from anodes. The present invention can be used to remove any substance from any plate where the substance can be removed by repeatedly striking the substance.

Figure 1:
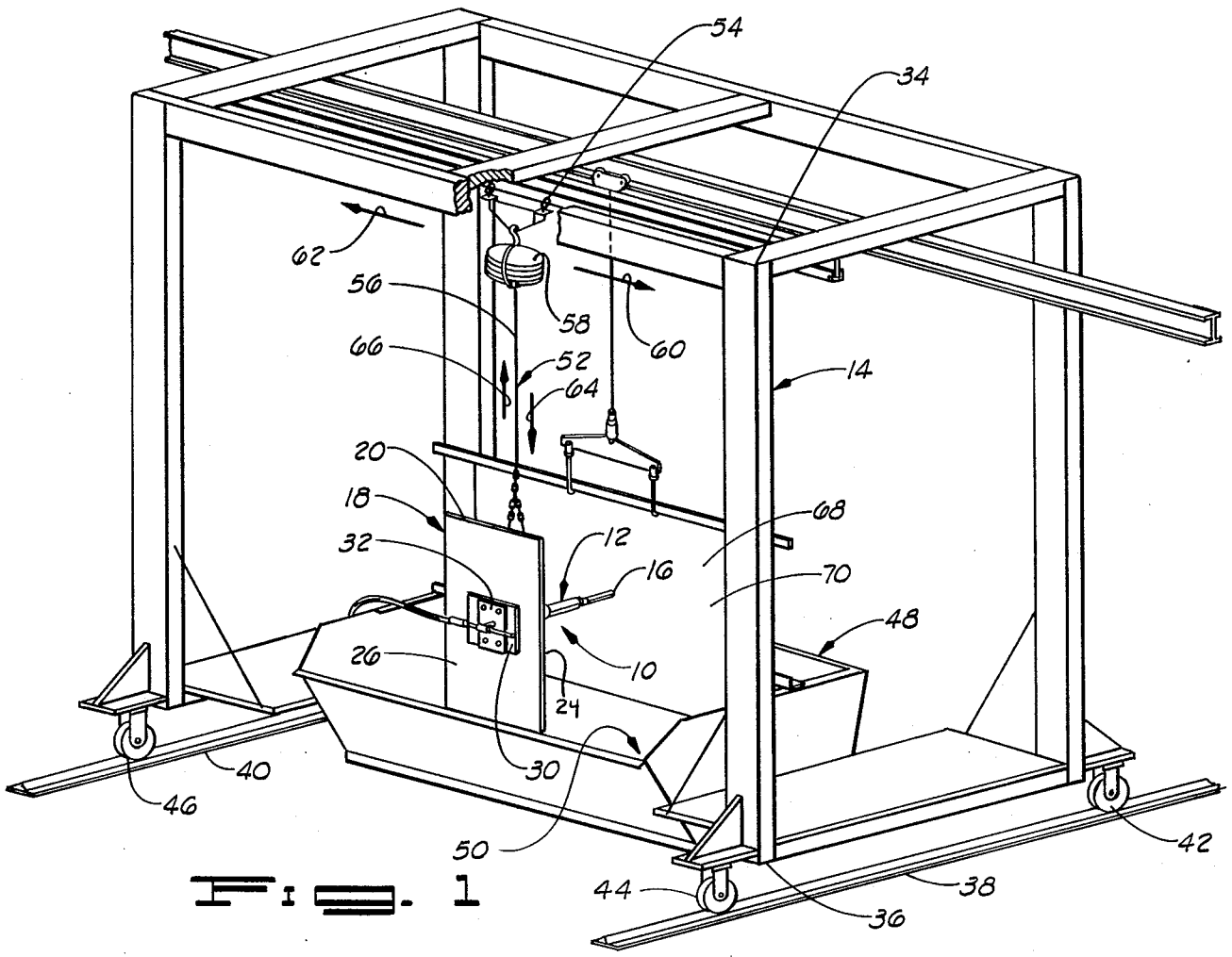
FIG. 1 is a partial perspective view of a harvester constructed in accordance with the present invention, and showing a suspended pate operatively positioned with respect to the harvester.
Figure 2:
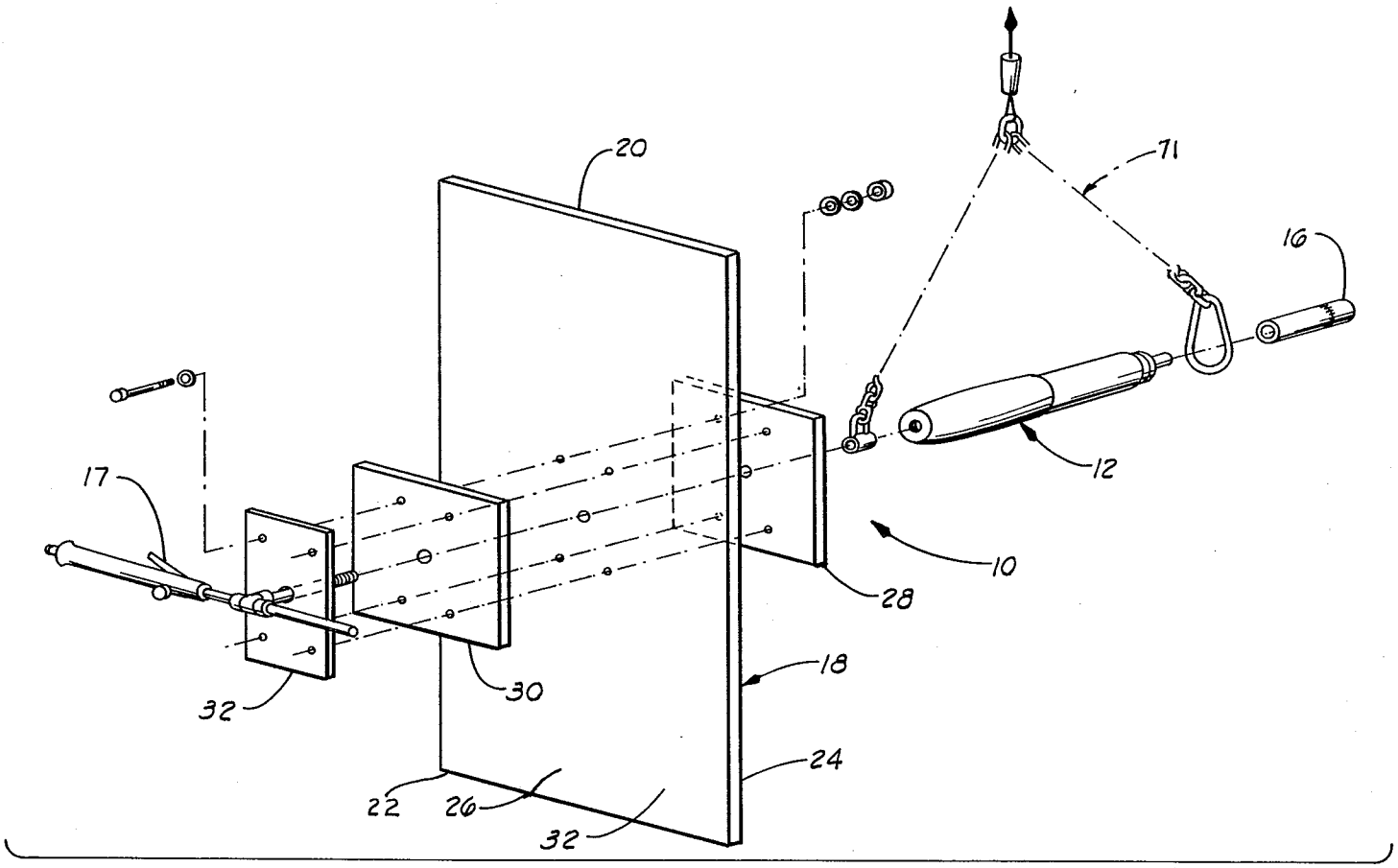
FIG. 2 is an exploded view showing the tool and guard portions of the harvester shown in FIG. 1.

Shown in FIGS. 1 and 2 is a harvester 10 which is constructed in accordance with the present invention. The harvester 10 generally comprises a tool 12 and a frame assembly 14 for supporting the tool 12.

The tool 12 has a strike end 16. In an on condition of the tool 12, the strike end 16 is moveable repeatedly back-and-forth in the tool 12 in a reciprocating motion. The strike end 16 of the tool 12 repeatedly is extended from the tool 12 in a striking motion in the on condition of the tool 12.

The tool 12 is connected to an air supply (not shown) for conditioning the tool 12 in the on condition when operatively connected to such air supply. The tool 12 includes a manually operated valve 17 (shown in FIG. 2) for operatively connecting the air supply to the tool 12 for conditioning the tool 12 in the on condition.

Tools which are adapted to function in a manner like that described before with the tool 12 are commercially available such as a tamper, model 441A2 commercially available from Ingersoll-Rand. The strike end 16 is a redesign of the standard butt normally provided with tool 12 and is manufactured from 4130 crome-moly steel. This particular tool is pneumatically operated.

The tool 12 extends through a central portion of a guard 18. The tool 12 is connected to the guard 18. The guard 18 generally is rectangularly shaped and has an upper end 20, and a lower end 22 (shown in FIG. 2), a forward face 24 and rearward face 26. The guard 18 is constructed of a substantially transparent material.

The guard 18 includes reinforcing plate 28, 30 and 32 (the reinforcing plates are shown in FIG. 2). The reinforcing plates 28, 30 and 32 are secured to a central portion of the guard 18 for reinforcing the guard 18. The frame assembly 14 includes opposite sides, an upper end 34 and a lower end 36. The lower end 36 of the frame 14 is rollingly supported on spaced apart rails 38 and 40 via wheels 42, 44 and 46 (one of the wheels supporting the frame 14 not being shown in the drawings).

A bin 48 is disposed generally within the frame assembly 14. The bin 48 includes a receiving space 50 formed in a portion thereof.

The cable assembly 52 comprises a cable 56 and a balancer 58. One end of cable 56 is connected to chain sling 71 (shown in FIG. 2) and the opposite end of cable 56 is operatively connected to the balancer 58. The balancer 58 is movably connected to the track 54 so that the cable assembly 52 and the guard 18 connected thereto can be moved on the track 54 in directions 60 and 62. The balancer 58 is adapted to support the guard 18 and the tool 12 connected thereto so that the cable 56 can be extended from the balancer 58 thereby moving the guard 18 and tool 12 connected thereto in a downwardly direction 64 or so that the cable 56 can be withdrawn into the balancer 58 thereby moving the guard 18 and tool 12 connected thereto in a generally upwardly direction 66.

Balancers capable of operating in a manner just described with respect to the balancer 58 are well known in the art and commercially available. One balancer which is suitable for use is the balancer 58 is commercially available from Ingersoll-Rand and is a swivel type of balancer, Ingersoll-Rand model BHD56, for example.

As shown in FIG. 1, a plate 68 which may be the anode having the manganese dioxide substance deposited thereon is supported generally over and partially within the receiving space 50 of the bin 48. The plate 68 has a forward surface 70 and a rearward surface (not shown in the drawings). In the particular example given before, manganese dioxide is deposited on the forward surface and the rearward surface (not shown) of the plate 68.

The guard 18 with the tool 12 connected thereto is positioned generally in front and near the forward surface 70 of the plate 68 to a position wherein the strike end 16 of the tool 12 is disposed generally adjacent a portion of the forward surface 70 of the plate 68. In this position, the operator actuates the valve 70 thereby causing the strike end 16 of the tool 12 to be reciprocatingly moved for repeatedly striking the substance deposited on the forward surface 70 of the plate 68 thereby causing the deposited substance to be broken from the plate 68 and dropped into the receiving space 50 of the bin 48. In the particular application of harvesting manganese dioxide, it has been found that the striking of the forward surface 70 of the plate 68 also results in the manganese dioxide deposited on the rearward surface of the plate 68 to be broken from the plate 68 and deposited within the receiving space 50 of the bin 48.

The operator moves the guard 18 and the tool 12 connected thereto from side-to-side generally between the opposite sides of the frame assembly 14 in directions 60 and 62 and up-and-down generally between the upper and lower ends 34 and 36 of the frame assembly 14 in directions 64 and 66 to position the strike end of the tool generally adjacent different portions of the forward surface 70 of the plate 68 and for strikingly engaging different portions of the substance deposited on the forward surface 70 of the plate 68 with the strike end 16 of the tool until all of the substance deposited on the forward surface 70 of the plate 68 has been removed therefrom and deposited generally within the receiving space 50 of the bin 48.

During the operation of breaking the deposited substance from the plate 58, the operator operates the tool 12 from a position standing near the rearward face 26 of the guard 18 so that the guard 18 is positioned generally between the operator and the strike end of the tool 12. The guard 18 protects the operator from fragments of the deposited material hitting the operator as the deposited material is being broken from the plate 68. The guard 18 is transparent so the operator can see the tool 12 striking the deposited substance on the plate 68 and so the guard 18 does not interfere with the operator effectively operating the tool 12 to remove the substance from the plate 68.

Changes may be made in the construction and operation of the various components and assemblies described herein without departing from the spirit and the scope of the invention as defined in the following claims.

What is claimed is:

1. A method for harvesting manganese dioxide deposited on a surface of a plate using a tool having a strike end which is repeatedly movable, comprising the steps of:

supporting the plate from a frame assembly;

supporting the tool from the frame assembly near the plate with the strike end being disposed generally near the surface of the plate;

operating the tool so the strike end repeatedly strikingly engages the manganese dioxide deposited on the surface of the plate for breaking the deposited manganese dioxide to remove the deposited manganese dioxide from the surface of the plate;

moving the tool to various positions over the surface of the plate for repeatedly strikingly engaging the deposited manganese dioxide at various positions over substantially the entire surface of the plate whereby the manganese dioxide is removed from the surface of the plate; and receiving the manganese dioxide removed from the surface of the plate.

2. The method of claim 1 further comprising:

supporting a guard constructed of a transparent material about the tool for substantially protecting the operator of the tool from the manganese dioxide being removed from the surface of the plate.

3. A harvester for removing a substance deposited on the surface of a plate, comprising:

a plate, a frame assembly having a first side, a second side, an upper end and a lower end;

means for supporting the plate on the frame assembly;

a tool having a strike end, the strike end being repeatedly moveable in and out in an on condition of the tool;

means for conditioning the tool in the on condition to strike the plate;

means for movably supporting the tool on the frame assembly with the strike end of the tool disposed near the surface of the plate for moving the tool in directions generally toward the first side and generally toward the second side and generally toward the first end and generally toward the second end of the frame assembly, said means movably supporting the tool for movably positioning the strike end of the tool at various positions over the surface of the plate whereby the strike end of the tool is positionable to repeatedly strike the substance on the plate in the on condition of the tool at various positions over substantially the entire surface of the plate whereby the substance is removed from the plate; and means for receiving the substance removed from the plate.

4. The harvester of claim 3 defined further to comprise:

a guard connected to the tool for substantially shielding the operator of the tool from pieces of substance removed from the plate.

5. The harvester of claim 4 wherein the guard is defined further as being constructed of a substantially transparent material, the tool extending through a portion of the guard whereby the guard is disposable between the operator of the tool and the plate.

6. The harvester of claim 5 wherein the guard is defined further as being substantially rectangularly shaped, and wherein the tool extends through a central portion of the guard.

7. The harvestor of claim 5 wherein the means for supporting the tool is defined further as comprising:

means movably connected to the frame generally near the upper end of the frame and connected to the guard for moving the guard and the tool connected thereto generally between the opposite sides and generally between the upper and lower ends.

8. An improvement in a system for harvesting manganese dioxide deposited on a surface of a plate, the improvement comprising:

a frame assembly having a first side, a second side, an upper end and a lower end;

means for supporting the plate on the frame assembly;

a tool having a strike end, the strike end being repeatedly moveable in and out in an on condition of the tool;

means for conditioning the tool in the on condition to strike the plate; and means for movably supporting the tool on the frame assembly with the strike end of the tool disposed near the surface of the plate for moving the tool in directions generally toward the first side and generally toward the second side and generally toward the first end and generally toward the second end of the frame assembly, said means movably supporting the tool for movably positioning the strike end of the tool at various positions over the surface of the plate whereby the strike end of the tool is positionable to repeatedly strike the substance on the plate in the on-condition of the tool at various positions over substantially the entire surface of the plate whereby the substance is removed from the plate; and means for receiving the substance removed from the plate.

9. The improvement of claim 8 defined further to comprise:

a guard connected to the tool for substantially shielding the operator of the tool from pieces of substance removed from the plate.

10. The improvement of claim 9 wherein the guard is defined further as being constructed of a substantially transparent material, the tool extending through a portion of the guard whereby the guard is disposable between the operator of the tool and the plate.

11. The improvement of claim 10 wherein the guard is defined further as being substantially rectangularly shaped, and wherein the tool extends through a central portion of the guard.

12. The improvement of claim 10 wherein the means for supporting the tool is defined further as comprising:

means movably connected to the frame generally near the upper end of the frame and connected to the guard for moving the guard and the tool connected thereto generally between the opposite sides and generally between the upper and lower ends.

* * * * *